US006101900A

United States Patent [19]

Traspuesto Miguel

[11] Patent Number: 6,101,900

[45] Date of Patent: Aug. 15, 2000

[54] CORKSCREW

[76] Inventor: Francisco Jose Traspuesto Miguel, Avenida Florida, 202, 36213 Vigo, Spain

[21] Appl. No.: 09/023,675

[22] Filed: Feb. 13, 1998

[30] Foreign Application Priority Data

Feb. 14, 1997 [ES] Spain ..... 9700307

[51] Int. Cl.[7] ..... B61B 7/04

[52] U.S. Cl. ..... 81/3.48; 81/3.09; 81/3.36

[58] Field of Search ..... 81/3.09, 3.36, 81/3.37, 3.48

[56] References Cited

U.S. PATENT DOCUMENTS 786,492 4/1905 Garimaldi ..... 81/3.37 X 5,454,282 10/1995 Del Mistro ..... 81/3.48

FOREIGN PATENT DOCUMENTS 0041026 5/1981 European Pat. Off. .

0143475 9/1984 European Pat. Off. .

93041616 U 6/1993 Germany .

260177 8/1981 Spain .

901047 U8 4/1989 Spain .

*Primary Examiner*—James G. Smith

*Attorney, Agent, or Firm*—Ostrolenk, Faber, Gerb & Soffen, LLP

[57] ABSTRACT

A corkscrew assembly contains the combination of a body, a corkscrew and a lever, in which the lever has a lever extension slidably nested within a recess therein, the extension being movable between a first and second position and the extension extends beyond the free end of the lever in the second position.

13 Claims, 4 Drawing Sheets

CORKSCREW

The present application for a Patent of Invention consists, as indicated in its title, in an "IMPROVED CORKSCREW", which novel characteristics of manufacturing, shaping and design fullfill the object for which it has been designed with a maximum safety and efficiency.

There exist in the market and therefore can be considered the state of the art, corkscrews such as the disclosed and claimed in the Utility Model No. 260,177 to same asignee, relative to a classical type corkscrew, commonly named "waiter's", which comprises a metal handle of a cross-section "U" shaped, having at one-end a foldable arm, also in "U" shaped cross-section, prepared for leaning on the bottle's neck, whilst at a median point of said handle is adapted the classical corkscrew which may adopt either a working position, in which comes out of same in an orthogonal direction, or a rest position where it is lowered over same.

Completing all the above, said corkscrew includes a small penknife, articulated at the opposite end of the handle, intended for easing the unsealing and uncapsulating operations, and in the opposite end is mounted a crown cap opener with a couple of similar and confronted lateral slots, with a suitable form provided in the foldable arm making possible its specific utilization. Said Utility Model improved the so-called waiter's corkscrews in the sense of providing a similar plastic body having elasticity characteristics, obtained in a fully independent process and which remained fitting and adjusting over said handle, allowing the free play of the elements articulated in the same, being fixed its position by means of the same transverse rivets.

Afterwards and also to same asignee was applied for the Utility Model No. 8901046 for "Disposición perfeccionada aplicable a sacacorchos ("Improved arrangement applicable to corkscrews"), in which the improvements were mainly based on fully closing the rear portion of the sheath limiting the extension of the longitudinal opening that the same presents, and eliminating the holes corresponding with the axis of two of the articulated elements that comprised the device; the foldable arm and the penknife.

The use and sale of said corkscrews under said Utility Models has shown that, in certain circumstances, the combined work of the corkscrew and the foldable arm with a "U" shaped cross-section, which presents in its lateral branches confronted recesses in the ends suitable for easing leaning over the bottle's neck, are not suitable for the extraction from said neck of corks of a length greater than the standard, which causes to the corkscrew to work in an inclined position and when said cork has half its length out of the neck, the metal portion leaning over the end of the neck does not work any more as a lever because of lack of length, it being necessary to a half of the length of the cork still inside of the neck by pulling with too great a force without any type of support over the neck, which may cause either breaking of the cork or the untimely exit of same and the spilling of part of the liquid contained in the interior of the bottle.

Therefore, the pulling out of this type of corks of a greater length is difficult with the conventional corkscrews because of the lack of length of said foldable arm, which carries out the function of an articulated lever in the body of the corkscrew.

In order to provide a solution to this type of problems and to be able to provide a single corkscrew that may be able to function with corks of different lengths, there has been created a corkscrew with a double effect since it is provided with two arms, one fixed and the other movable, sliding inside of the fixed one, and which allows the extraction of the cork or cap with a single action. It starts operating the fixed arm and when it arrives at an angle of about 90° starts working the movable support, producing an elongation of the arm until the total cork is pulled out of the the upper portion of the bottle's neck. Once the force is retired, the movable arm retracts inside the fixed one.

In the proposed corkscrew, the crown caps opener has been situated in the body of the sheath, making it not necessary to open the foldable arm, and making it possible to proceed to pull out the crown caps singlehandedly.

Said double effect is obtained with a foldable arm designed in the shape of a runner allowing the unfolding of same since there has been provided one metal part inside the other, it being possible for the second one to slide in the interior of the first since there has been provided in the base a suitable means, such as a closed groove and another groove open, provided with the corresponding rivet and a spring between the two metal parts forming the arm.

Other details and characteristics of the present invention will be manifest through the reading of the description given herebelow, in which reference is made to the figures attached to this description where the above details are depicted in a rather schematic way. These details are given as an example, referring to a case of a possible practical embodiment, but is not limited to the details outlined; therefore this description must be considered from an illustrative point of view and with no limitations whatsoever.

There follows a detailed report of the several elements named in the present description: (10) corkscrew, (11) molded body, **(11*a*) closed zone, (12) penknife, (13) corkscrew, (14) channel, (15) foldable arm, exterior metal part (15') exterior metal part, (15*a*) slot, (15*b*) base, (15*c*) open slot, (15*d*) wings, (16) rivet, (17) end recesses, (18) void zone, (19) end bridge, (20) body, (21) hole, (22) hole, (23) confronted flanges, (21) flange, (25) hole, (26) rivet, (27) groove, (28) sheath perimeter, (29) end of (15), (30) spring, (31) stop, (32) neck, (33)** bottle's neck.

Figure 1:
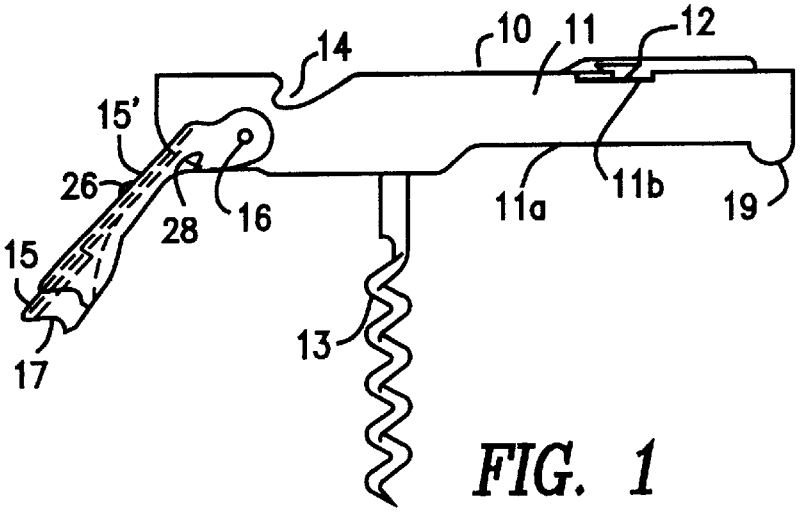
FIG. 1 is an elevation front view of the improved corkscrew (10) in which the main elements, such as the molded body (11), a penknife (12), a corkscrew (13) and the foldable arm (15) can be seen.

In one of the preferred embodiments of the present application, and as can be seen in FIG. 1, the corkscrew (10) presents in a known way a penknife (12) in an upper portion of the molded body (11) which has a void zone (18) for being able to protect the penknife (12) in a rest position, whilst in an opposite portion of said body (11) there is the corkscrew (13), which in a folded position is lodged in the interior of a wide closed zone (11*a*) which ends in the end bridge (19). At the opposite end of said body (11) there is the foldable arm having an exterior metal part (15') which is articulated with body (11) through a rivet (16), exterior metal part (15') having another part practically alike (15) but of lesser width which slides inside of the first one.

Figure 7:
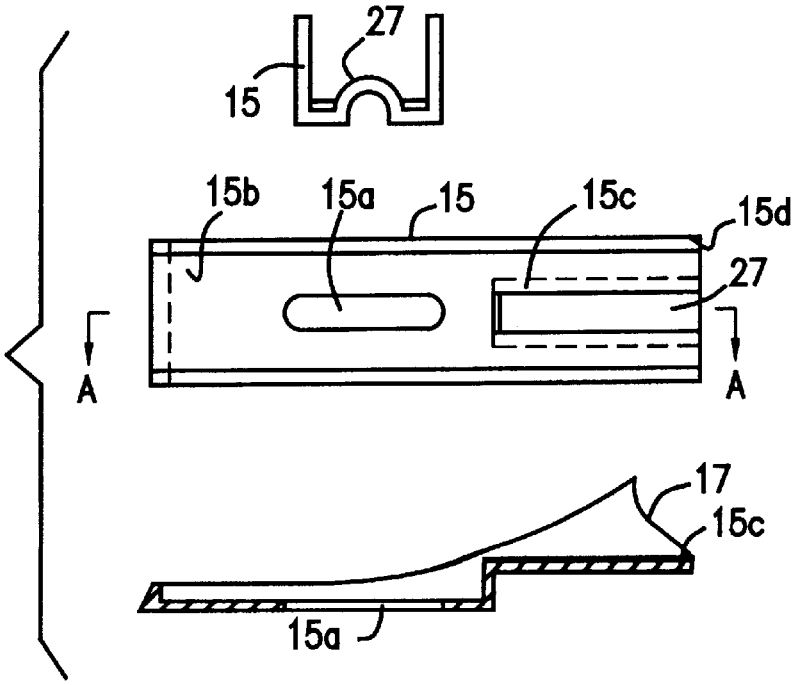
FIG. 7 is lower plant views in lateral elevation and cross section of the metal part (15).

The metal part (15) has been designed as can be seen in FIG. 7 with a flat base (15*b*) from which emerge perpendicularly wings (15*d*) which have end recesses (17) and a slot (15*a*).

Figure 8:
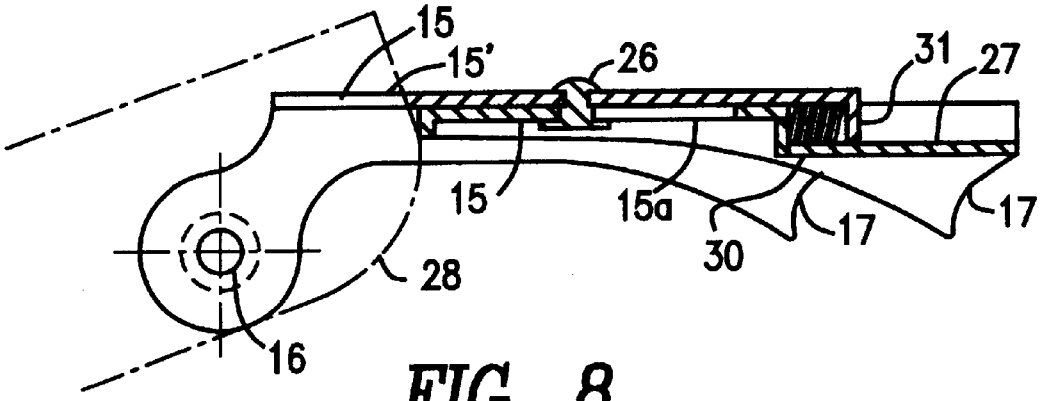
FIG. 8 is an elevation longitudinal cross section of the foldable and extensible arm (15') in the maximum elongation position.
Figure 9:
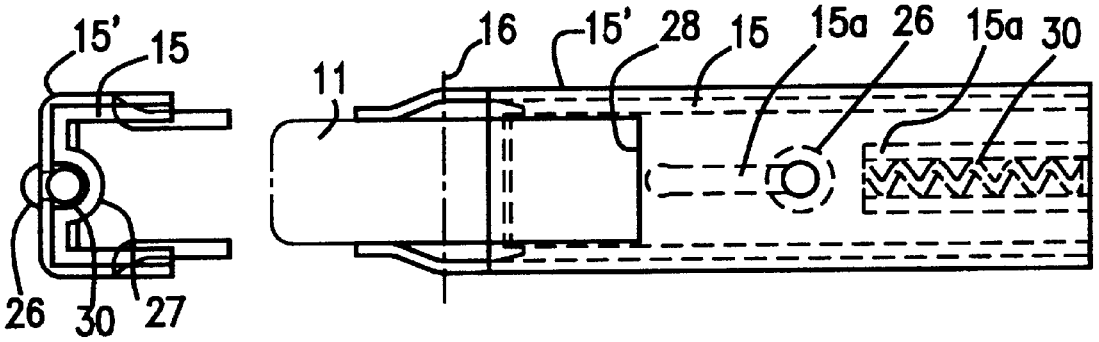
FIG. 9 is an elevation upper view of the foldable arm (15-15') and an elevation front view of same.
Figure 10:
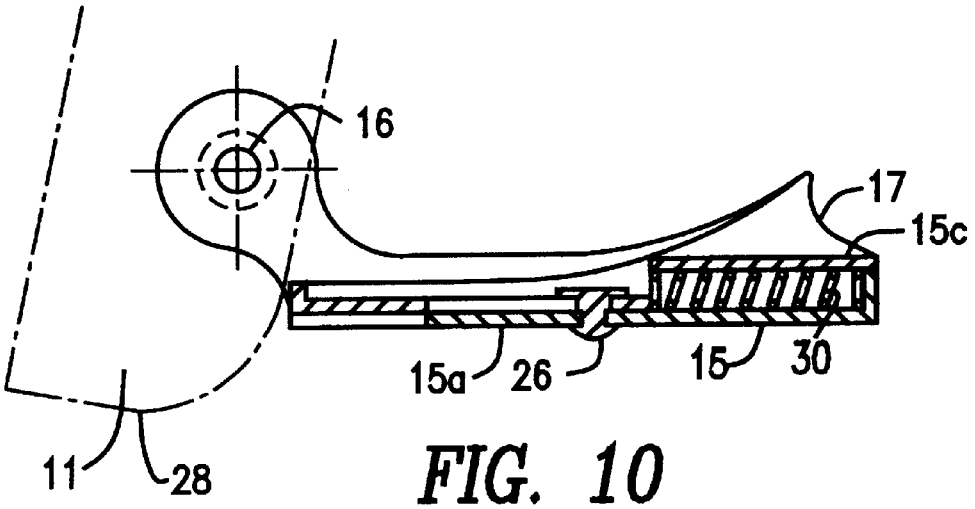
FIG. 10 is an elevation longitudinal cross section view of the foldable arm (15 15') in a minimum elongation position.

The exterior metal part (15') lodging the part (15) allows the sliding of part (15) through the first exterior metal part (15') interior by having a rivet (26) which is connects part (15) to the exterior metal part (15') with the help of a slot (15*a*). See FIGS. 8, 9 and 10. The base (15*b*) of the exterior metal part (15') has an open slot (15*c*). the unfolding of part (15), from the free end of the exterior metal part (15') is obtained when sliding the end (29) of part (15), see FIGS. 7 and 12, through the perimeter (28) of the sheath (11) and rotating exterior metal part (15') in the counter-clockwise sense in a continuous and progressive way with the rotation center in the rivet (16).

In normal working conditions and when what is desired is to pull out the cap or cork (34) from the interior of the cap's neck (33) from a conventional bottle with standard dimensions, one will be working in a known form with the part (15) totally lodged and protected in the interior of exterior metal part (15'). When the cork (34) is of a length greater than the normal, it's forced with a simple pressure of the sheath perimeter (28) over the end (29) or part (15) and with the cooperation of the rivet (26) and the slot (15*a*) to lengthen its lever arm length thereby compensating the larger run of the corkscrew (13), all that in a progressive way and obtaining a so-called "double effect". In other words, with the same corkscrew it's possible to pull out standard dimension corks and others of a greater length, having joined in the same corkscrew two complementary effects. The first effect is where the part (15) is secluded in the interior of the exterior metal part (15') and the exterior metal part (15') leans over the bottle's neck (32) through the end recesses (17), and the second effect is where the part (15) slides from the interior of exterior metal part (15') outwards with the help of the spring (30) representing a way or manner for having a supplementary lever arm length, in order to compensate for the higher length of the cork (34).

The other elements constituting the corkscrew (10) and described in FIG. 1 have the same functions as the earlier models to same asignee.

Figure 2:
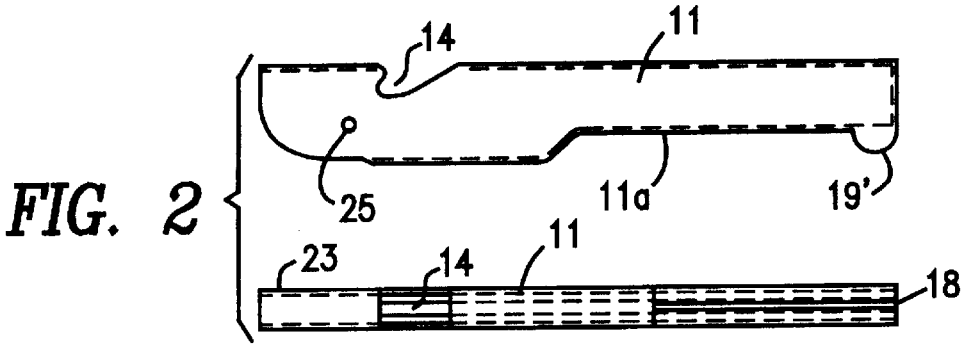
FIG. 2 is elevation front and lower plant views of the molded body (11).
Figure 3:
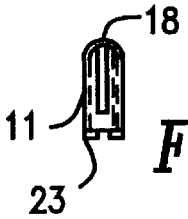
FIG. 3 is an elevation front view of the molded body (11) in which can be seen the void zone (18) and the confronted flanges (23) being placed in the void zone (18).

As can be seen in FIG. 2, the sheath (11) presents, as is a known form, a configuration markedly in the shape of an "U", as can be seen in FIG. 3, with wings in whose ends can be found confronted flanges (23), whilst in the upper portion is delimited a void zone (18) with the object that the penknife (12) may remain hidden and protected by the sheath (11).

In the upper part of the sheath (11) there is a channel (14), see FIG. 1, which allows the corkscrew (10) to pull out crown caps and the like by leaning the corkscrew (10) by the zone or channel (14) and using leverage over said crown cap, fitting it on the edges of said channel (14), to allow an advantageous effect since the corkscrew may be worked by a single hand of the user, avoiding the need for help of the other hand for deploying the exterior metal part (15') and pulling out crown caps with the lower profile of exterior metal part (15') as was necessary with the other corkscrews actually in the market.

Figure 12:
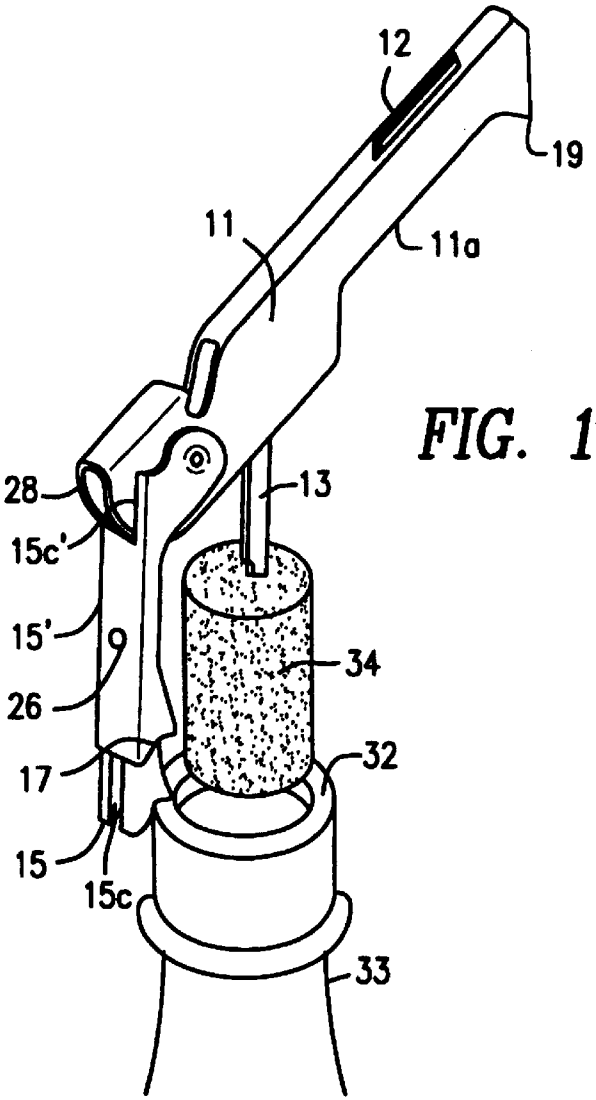
FIG. 12 is a perspective view of the corkscrew (10) in a working position in which the arm (15) extends from the interior of exterior metal part (15') in order to obtain a longer lever arm when the corkscrew (13) takes out a cork (34) from the cap's neck (33) of a conventional bottle.
Figure 11:
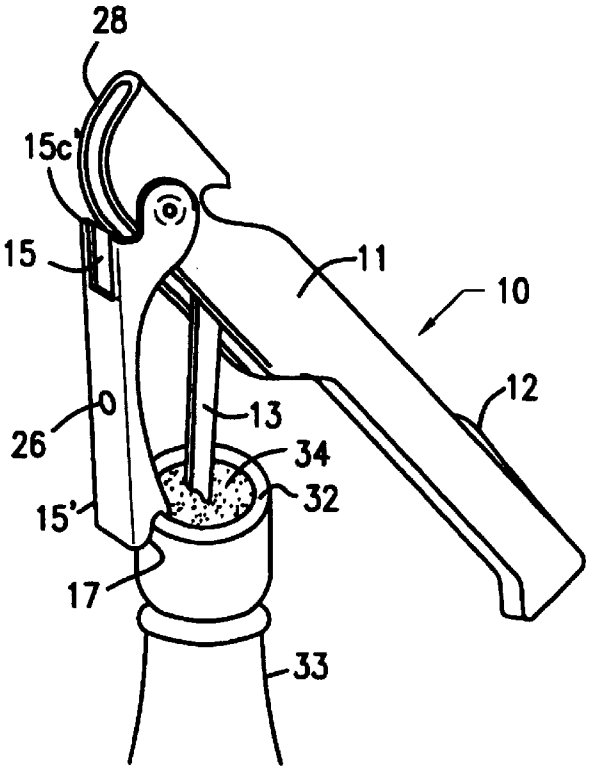
FIG. 11 is a perspective view of the corkscrew (10) in working position in which the arm exterior metal part (15') is leaning against the bottle's neck (32) of the cap's neck (33) of a conventional bottle.

The double effect action of the corkscrew (10) is at the same time a progressive effect, that is to say, as can be seen in FIGS. 11 and 12, it does not remain limited to two types of caps (34), but also to those having intermediate lengths, being adapted by the length of the foldable arm (15-15')) to the length of the corks.

Figure 4:
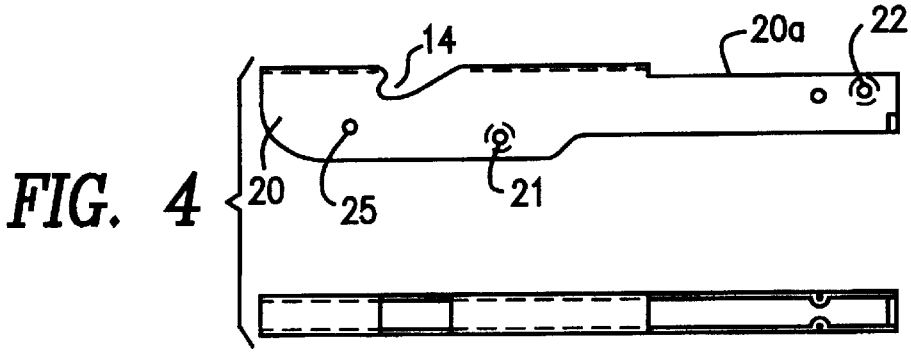
FIG. 4 is elevation front views of the metal body (20) of the corkscrew (10), and a lower plant view of same body (20).
Figure 5:
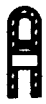
FIG. 5 is an elevation cross section of the body (20).
Figure 6:
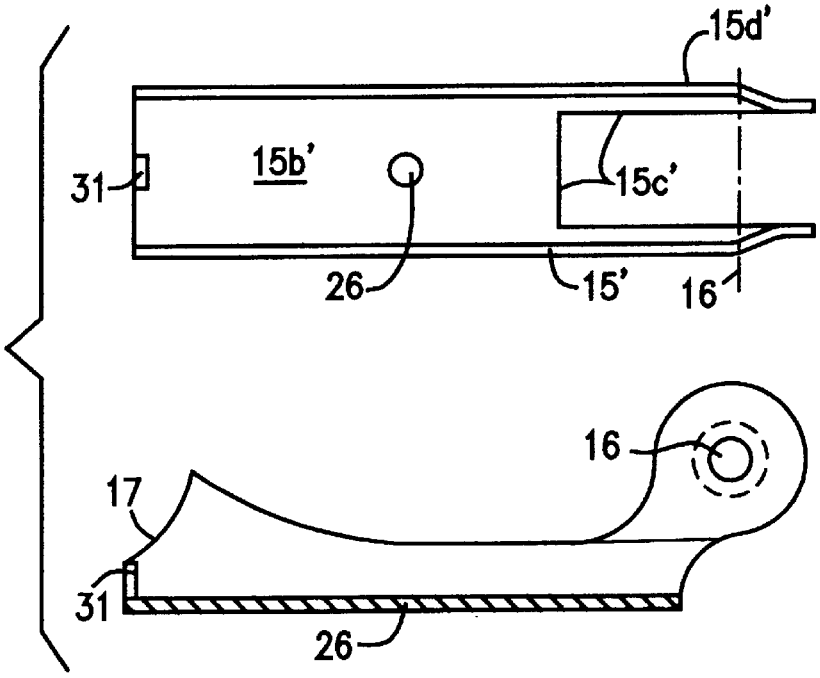
FIG. 6 is lower plant views in lateral elevation and cross section of the exterior metal part (15').

As can be seen in FIG. 4, the corkscrew (10) incorporates in a known form a body (20) having holes (18, 21 and 22 for immobilizing the rivet (16) in the interior of the hole (18) and allow the rotation of the exterior metal part (15'), a hole (21) allowing the rotation of the corkscrew (13) and the hole (22) for the rotation of the penknife (12).

It is understood one can introduced in any detail modifications regarded as convenient without departing from the essence of the present patent of invention as set forth in the following Claims.

What is claimed is:

1. In a corkscrew assembly comprising a body, a corkscrew attached to the body and a lever spaced from said corkscrew and having one end pivotally attached to the body, the improvement which comprises the lever having a groove extending from a second end of the lever toward said one end and having a lever extension slidably nested in said groove and being slidably movable between a first and second position, wherein the extension extends beyond said second end in said second position.

2. The corkscrew assembly of claim 1, wherein the corkscrew is pivotally attached to the body and the lever and lever extension have U-shaped cross-sections.

3. The corkscrew assembly of claim 2, having a knife pivotally attached to the body.

4. A corkscrew assembly comprising an elongated body; a corkscrew pivotally attached to a generally central location along an axis of said elongated body; a variable length lever assembly comprising first and second elongated members slidably attached to one another; said first elongated member being pivotally attached to one end of said elongated body; said elongated body having a cam surface disposed adjacent said one end of said elongated body; one end of said second elongated member being slidably coupled to said cam surface, whereby said second elongated member is longitudinally moved relative to said first elongated member when said first elongated member is rotated at least through a given range, relative to said one end of said elongated body.

5. The corkscrew assembly of claim 4, wherein said first and second elongated members have U-shaped cross-sections.

6. The corkscrew assembly of claim 5, wherein said second elongated member is disposed within said U-shaped cross-section of said first elongated member.

7. The corkscrew assembly of claim 6, having a knife blade pivotally attached to said elongated body at a point distant from both said corkscrew and said lever assembly.

8. The corkscrew assembly of claim 7, wherein one of said first and second elongated members has a slot along the axis of said elongated member and having a rivet passing through said slot and the other of said first and second elongated members.

9. The corkscrew assembly of claim 8 which further includes a biasing spring connected between said first and second elongated members for biasing said second member into contact with said cam surface.

10. The corkscrew assembly of claim 9 wherein said first elongated member has a flange disposed at a point distant from the point of pivotable attachment and one end of said biasing spring abuts said flange.

11. The corkscrew assembly of claim 10 wherein said flange is disposed at a point further from the point of pivotable attachment than said rivet and wherein said elongated body has first and second recesses disposed on opposite sides of said axis adapted to receive at least a portion of said corkscrew and knife, respectively, at one position through which said corkscrew and knife, respectively, can be pivoted.

12. The corkscrew assembly of claim 4 which further includes a biasing spring connected between said first and second elongated members for biasing said second member into contact with said cam surface.

13. The corkscrew assembly of claim 12 wherein said first elongated member has a flange disposed at a point distant from the point of pivotable attachment and one end of said biasing spring abuts said flange.

* * * * *